US005647446A

United States Patent [19]

Wenzel

[11] Patent Number: 5,647,446

[45] Date of Patent: Jul. 15, 1997

[54] TWO WAY HYDRAULIC DRILLING JAR

[75] Inventor: Kenneth Hugo Wenzel, Edmonton, Canada

[73] Assignee: Vector Oil Tool Ltd., Edmonton, Canada

[21] Appl. No.: 546,097

[22] Filed: Oct. 19, 1995

[51] Int. Cl.[6] ..... E21B 31/113

[52] U.S. Cl. ..... 175/297; 166/178

[58] Field of Search ..... 175/296, 297, 175/299, 300, 303, 306; 166/178, 301

[56] References Cited

U.S. PATENT DOCUMENTS

| | | | |
|---|---|---|---|
| 3,735,827 | 5/1973 | Berryman | 175/296 |
| 3,804,185 | 4/1974 | Mason | 175/297 |
| 3,880,248 | 4/1975 | Mason | 175/297 |
| 4,361,195 | 11/1982 | Evans | 175/297 |
| 4,582,148 | 4/1986 | Walter | 175/297 |
| 5,086,853 | 2/1992 | Evans | 175/297 |
| 5,123,493 | 6/1992 | Wenzel | 175/297 |
| 5,318,139 | 6/1994 | Evans | 175/297 |
| 5,431,221 | 7/1995 | Roberts et al. | 166/73 |

FOREIGN PATENT DOCUMENTS

| | | | |
|---|---|---|---|
| 1082682 | 7/1980 | Canada | 255/29 |

OTHER PUBLICATIONS

Brochure of Houston Engineers, Inc. published 1985 re Hydra–Jar.

Brochure of Dailey Petroleum Services Corp. published 1991 re Hydraulic Drilling Jar.

*Primary Examiner*—Frank Tsay

*Attorney, Agent, or Firm*—Anthony R. Lambert

[57] ABSTRACT

A two way hydraulic drilling jar which includes a tubular housing having an interior surface defining an interior bore. A mandrel is provided having an exterior surface. The mandrel is telescopically received within the interior bore of the tubular housing. The exterior surface of the mandrel has an enlarged diameter portion. An annular valve member is provided having a first end, a second end, and an interior surface defining an interior bore. The mandrel extends through the interior bore of the valve member. The valve member is confined with capability of limited axial movement between two shoulders projecting from the interior surface of the housing. The interior bore of the annular valve member receives the enlarged diameter portion of the mandrel in close fitting relation. At least one fluid bypass channel is disposed in one of the valve member and the enlarged diameter portion of the exterior surface of the mandrel. The fluid bypass channel extends longitudinally between the first end and the second end of the annular valve member. When the enlarged diameter portion of the mandrel is positioned in close fitting relation within the interior bore of the valve member, fluid can slowly bleed past to create a time delay before the enlarged diameter portion mandrel exits the interior bore of the valve member.

9 Claims, 7 Drawing Sheets

TWO WAY HYDRAULIC DRILLING JAR

FIELD OF THE INVENTION

The present invention relates to a two way hydraulic drilling jar.

BACKGROUND OF THE INVENTION

Most hydraulic jars are capable of jarring up, but not down. It is difficult to jar in both directions using a single hydraulic valve, due to problems in getting the valve to center itself properly in the restriction. For that reason most two way hydraulic jars, use two hydraulic valves, one of which is inverted.

U.S. Pat. No. 5,123,493 is an example of a two way hydraulic drilling jar that utilizes a single valve. U.S. Pat. No. 5,123,493 discloses an hydraulic drilling jar which is constructed of a mandrel that is telescopically received within a tubular housing. An annular fluid chamber is formed between the mandrel and the housing. An annular valve member is disposed within the fluid chamber and is secured between two projecting shoulders on the exterior surface of the mandrel. As relative movement of the mandrel and the housing occurs the valve member moves axially in the fluid chamber. The interior surface of the housing has a restriction. The valve member moves freely in the fluid chamber until it reaches the restriction. Bypass passages are provided to enable fluid to bleed past the valve member when the valve member is positioned within the restriction. Should the drill string become stuck, the drill string is placed in either compression or tension, depending upon whether it is desired to jar up or jar down. The force exerted upon the drill string tends to cause relative movement of the mandrel and the housing. Only limited relative movement can occur, however, until after a time delay during which sufficient fluid bleeds through the bypass passages to enable the valve member to come out of the restriction. Once the valve member comes out of the restriction, the mandrel and housing are free to move and a hammer on one is brought into engagement with an anvil on the other in a violent jarring impact.

SUMMARY OF THE INVENTION

The present invention relates to an alternative configuration for a two way hydraulic drilling jar that utilizes a single valve.

According to the present invention there is provided a two way hydraulic drilling jar which includes a tubular housing having a first end, a second end and an interior surface defining an interior bore. A mandrel is provided having a first end, a second end and an exterior surface. The mandrel is telescopically received within the interior bore of the tubular housing. The exterior surface of the mandrel has an enlarged diameter portion. First sealing means are disposed between the interior surface of the housing and the exterior surface of the mandrel at the first end of the housing. Second sealing means are disposed between the interior surface of the housing and the exterior surface of the mandrel at the second end of the housing. An annular fluid chamber is formed between the exterior surface of the mandrel and the interior surface of the housing. The annular fluid chamber has a first end defined by the first sealing means and a second end defined by the second sealing means. An annular valve member is provided having an annular sidewall, a first end, a second end, an exterior surface, and an interior surface defining an interior bore. The annular valve member is disposed within the fluid chamber with the mandrel extending through the interior bore. The valve member is confined with capability of limited axial movement between two shoulders projecting from the interior surface of the housing. The interior bore of the annular valve member receives the enlarged diameter portion of the mandrel in close fitting relation. At least one hammer is provided on one of the mandrel and the housing. A first anvil is provided on the other of the mandrel and the housing that engages the at least one hammer in a jarring impact upon relative telescopic movement of the mandrel and the housing in a first direction. A second anvil is provided on the other of the mandrel and the housing that engages the at least one hammer in a jarring impact upon relative telescopic movement of the mandrel and the housing in a second direction. At least one fluid bypass channel is disposed in one of the valve member and the enlarged diameter portion of the exterior surface of the mandrel. The fluid bypass channel extends longitudinally between the first end and the second end of the annular valve member. When the enlarged diameter portion of the mandrel is positioned in close fitting relation within the interior bore of the valve member, fluid can slowly bleed past to create a time delay before the enlarged diameter portion mandrel exits the interior bore of the valve member resulting in the hammer and the anvil engaging in a violent jarring impact.

Although beneficial results may be obtained through the two way hydraulic drilling jar, as described, there are measures that can be taken to provide the fluid bypass channel with a variable flow depending upon the positioning of the enlarged diameter portion of the mandrel relative to the interior bore of the annular valve member. These modifications are of assistance in ensuring positioning of the enlarged diameter portion of the mandrel in the interior bore in preparation for jarring.

One approach to creating a variable fluid flow is to utilize a pair of radial fluid bypass ports. In accordance with this approach, A first radial fluid bypass port extends through the annular sidewall of the annular valve member adjacent the first end. A second radial fluid bypass port extends through the annular sidewall of the annular valve member adjacent the second end. Fluids can communicate between the interior surface and the exterior surface of the annular valve member. The radial fluid bypass ports are in fluid communication with the at least one fluid bypass channel, such that when a force is exerted upon the mandrel to push the enlarged diameter portion on the exterior surface of the mandrel into the close fitting interior bore of the annular valve member and the annular valve member is pushed against one of the projecting shoulders on the interior surface of the housing thereby blocking the at least one fluid bypass channel, hydraulic fluid flowing along the at least one fluid bypass channel is able to exit through one of the radial fluid bypass ports notwithstanding blockage of the at least one fluid bypass channel by one of the shoulders. This continues until the radial fluid bypass ports are also blocked by the enlarged diameter portion on the exterior surface of the mandrel, at which time the flow of hydraulic fluid through the radial fluid bypass ports is restricted thereby slowing the mandrel for positioning within the interior bore of the valve member in preparation for jarring.

Another approach to variable fluid flow is to utilize at least one radial bypass port, in combination with a plurality of fluid bypass channels. The at least one radial bypass port extends between some of the plurality of fluid bypass channels and the at least one of said plurality of fluid bypass channels that is positioned intermediate the spacer member and the interior surface of the valve member. When a force is exerted upon the mandrel to push the enlarged diameter portion on the exterior surface of the mandrel into the close fitting interior bore of the annular valve member and the annular valve member is pushed against one of the projecting shoulders on the interior surface of the housing thereby blocking some of the plurality of fluid bypass channels, hydraulic fluid flowing along the some of the plurality of fluid bypass channels that are blocked is able to pass through the at least one radial fluid bypass port to the at least one of said plurality of fluid bypass channels that is positioned intermediate the spacer member and the interior surface of the valve member which is not blocked.

Another approach that can be used alone or in combination with the other approach described above, is to utilize metering devices. In accordance with this approach, means for metering the flow of hydraulic fluid is provided in the at least one fluid bypass passage. Where metering devices are used it may be advisable to also provide means for filtering contaminants from the flow of hydraulic fluid. Contaminants will, of course, adversely effect the operation of the metering device.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

Figure 1A:
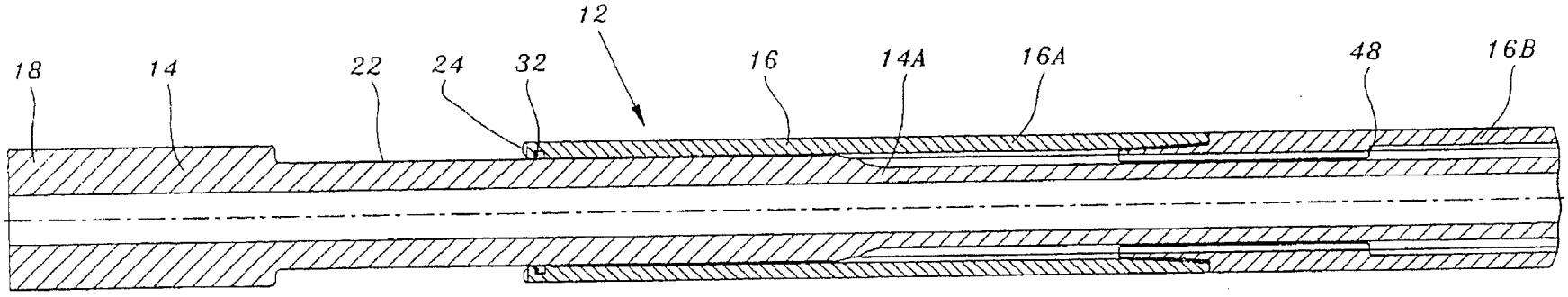
FIGS. 1*a* and 1*b* are longitudinal section view of an hydraulic drilling jar constructed in accordance with the teachings of the present invention, the drilling jar being divided into sections for the purpose of illustration.

The preferred embodiment, a two way hydraulic jar generally identified by reference numeral 12, will now be described with reference to FIGS. 1*a* through 7.

Figure 1B:
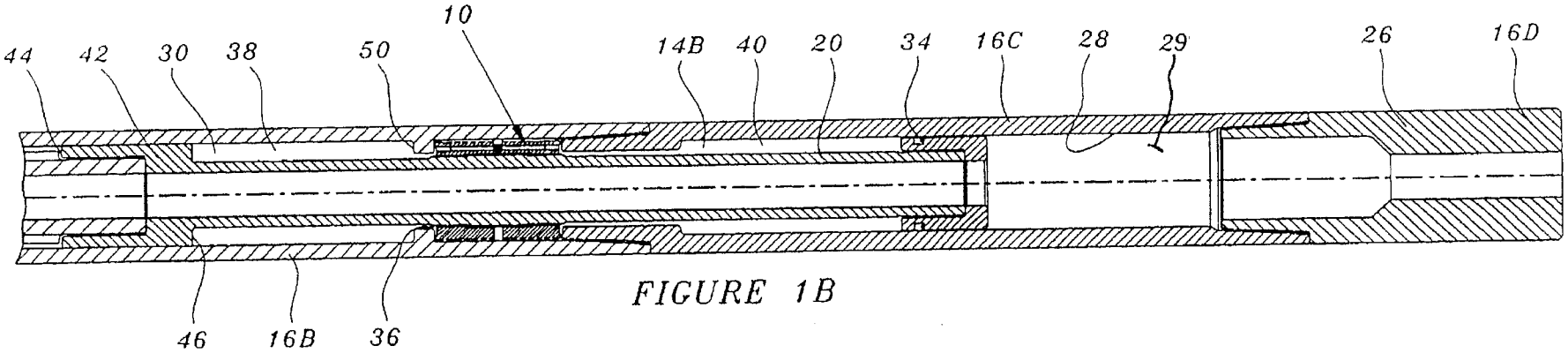
Figure 2:
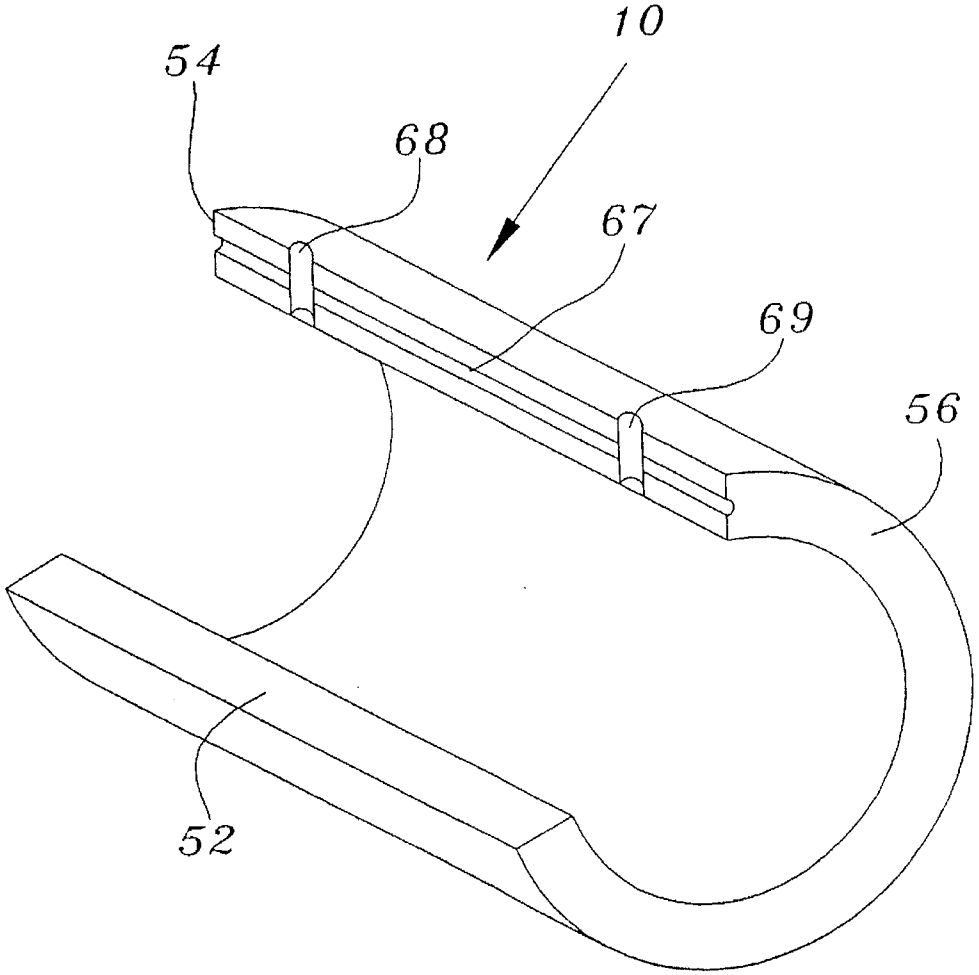
FIG. 2 is a perspective view of an annular valve member constructed in accordance with the teaching of the present invention.

Referring to FIGS. 1*a* and 1*b*, there is illustrated a two way hydraulic drilling jar 12 into which an annular valve member 10 is intended to be incorporated. Hydraulic jar 12 includes a mandrel 14 that is telescopically received within a tubular housing 16. Mandrel 14 has a first end 18, a second end 20 and an exterior surface 22. To facilitate assembly mandrel 14 comes in two threadedly connected sections 14*a* and 14*b*. Housing 16 has a first end 24, a second end 26, and an interior surface 28 defining an interior bore 29. To facilitate assembly, housing 16 comes in a number of threadedly connected sections 16*a*, 16*b*, 16*c*, and 16*d*. An annular fluid chamber 30 is formed between mandrel 14 and housing 16 by a first annular seal 32 and a second annular seal 34. First annular seal 32 is positioned at first end 24 of housing 16 and engages exterior surface 22 of mandrel 14. Second annular seal 34 is positioned at second end 20 of mandrel 14 and engages interior surface 28 of housing 16. Annular valve member 10, constructed in accordance with the teachings of the present invention, is disposed within annular fluid chamber 30, as will be hereinafter further described. Fluid chamber 30 can be said to be divided into two portions 38 and 40, positioned on either side of annular valve member 10. A hammer 42 is provided at the connection between mandrel components 14*a* and 14*b*. Hammer 42 has two contact faces; a first contact face 44 and a second contact face 46. A shoulder jutting out from interior surface 28 of housing 16 serves as a first anvil 48. First anvil 48 engages first contact face 44 of hammer 42 in a jarring impact upon relative telescopic movement of mandrel 14 and housing 16 in a first direction. A shoulder jutting out from interior surface 28 of housing 16 serves as a second anvil 50. Second anvil engages second contact face 46 of hammer 42 in a jarring impact upon relative telescopic movement of mandrel 14 and housing 16 in a second direction.

Figure 3:
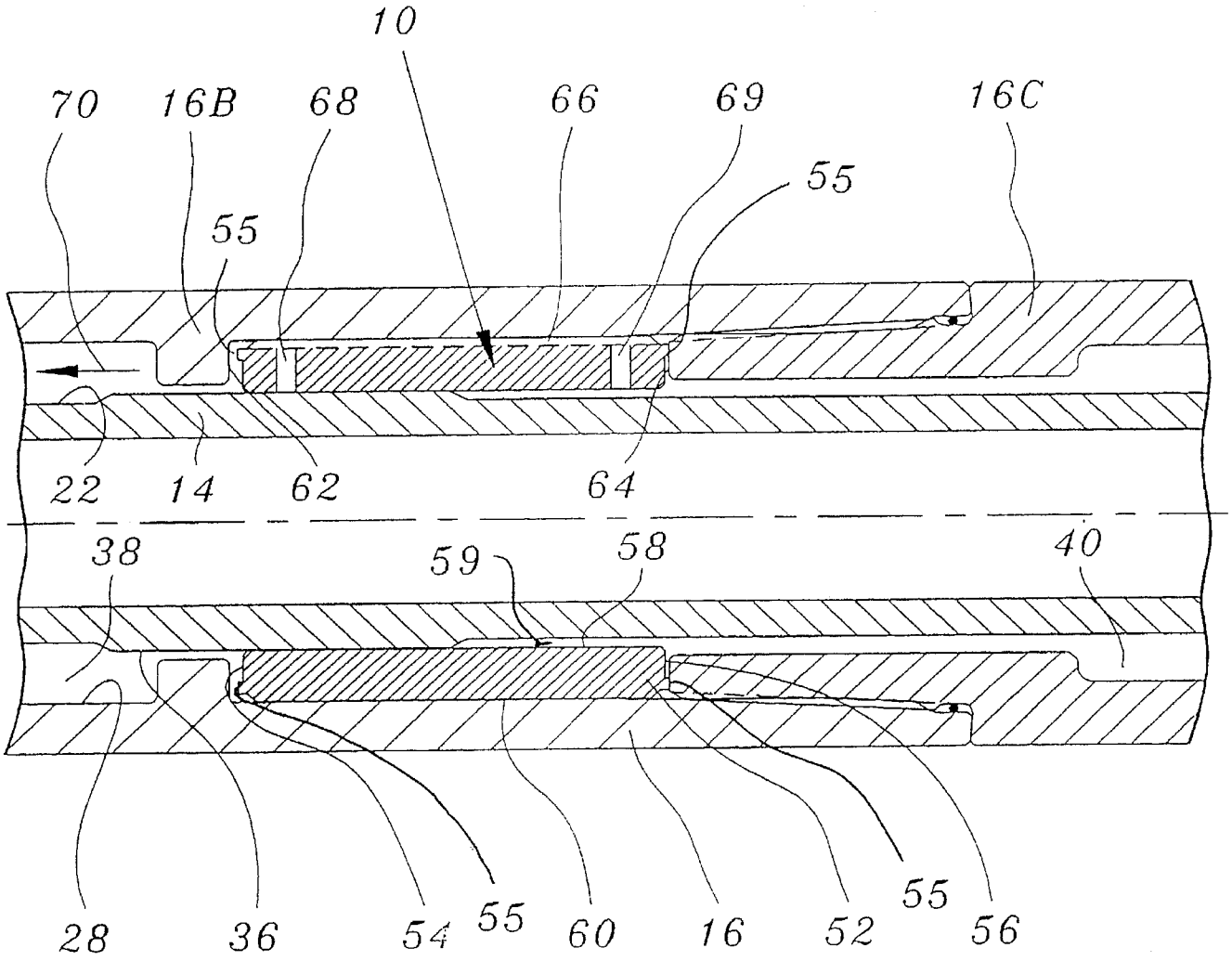
FIG. 3 is a longitudinal section view of an hydraulic drilling jar with the annular valve member illustrated in FIG. 2 entering a restriction.
Figure 4:
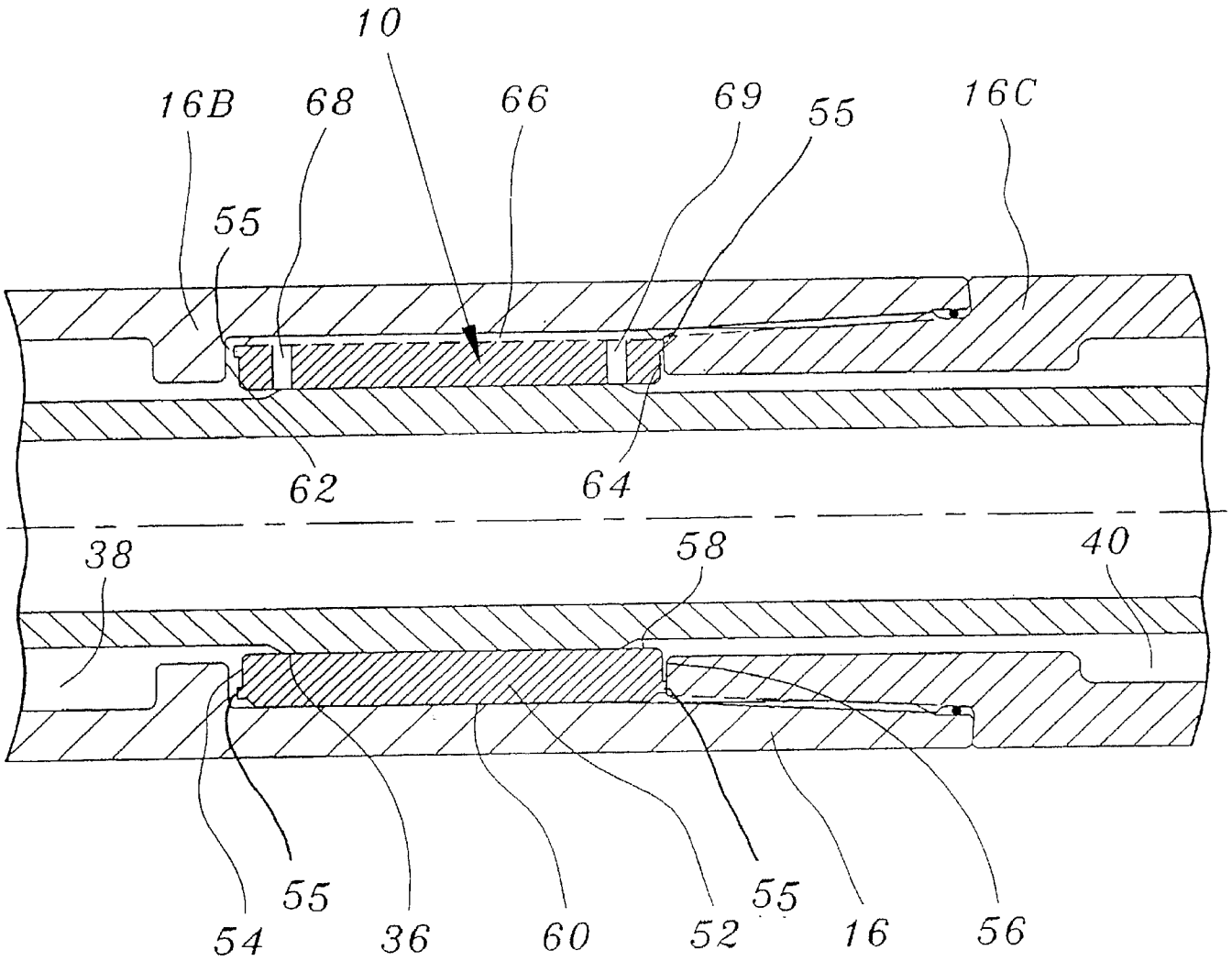
FIG. 4 is a longitudinal section view of an hydraulic drilling jar with the annular valve member illustrated in FIG. 2 centrally positioned in the restriction.

Annular valve member 10 will now be described. Referring to FIGS. 3 and 4, annular valve member 10 has an annular sidewall 52, a first end 54, a second end 56, an exterior surface 60 and an interior surface 58 defining an interior bore 59. Annular valve member is confined with capability of limited axial movement between two shoulders 62 and 64 positioned on interior surface 28 of housing 16. Mandrel 14 extends through interior bore 59 of annular valve member 10. Mandrel 14 has an enlarged diameter portion 36 that is received in close fitting relation within interior bore 59. A longitudinal fluid bypass channel 66 extends along exterior surface 60 of annular valve member 10 between first end 54 and second end 56. Longitudinal fluid bypass channel 66 is positioned immediately adjacent housing 16 between shoulders 62 and 64 which confine annular valve member 10 to a severely limited range axial movement. When annular valve member 10 moves axially in one direction, longitudinal fluid bypass channel 66 is blocked by shoulder 62. When annular valve member 10 moves axially in the other direction, longitudinal fluid bypass channel 66 is blocked by shoulder 64. A first radial fluid bypass port 68 and a second radial fluid bypass port 69 extend through annular sidewall 52 of annular valve member 10, such that fluids can communicate between interior surface 58 and exterior surface 60 of annular valve member 10. Radial fluid bypass ports 68 and 69 are in fluid communication with longitudinal fluid bypass channel 66. First radial bypass port 68 is positioned adjacent first end 54 of annular valve member 10 and second radial bypass port 69 is positioned adjacent second end 56 of annular valve member 10.

FIG. 3 illustrates enlarged diameter portion 36 of mandrel 14 entering interior bore 59 of annular valve member 10 in order to reset hydraulic drilling jar 12. The direction of movement of housing 16 is illustrated by arrow 70. As soon as a force is exerted upon mandrel 14, one of shoulders 62 or 64 is brought into engagement with annular valve member 10. In view of the direction of movement, shoulder 64 is shown engaging second end 56 of annular valve member. Shoulder 64 blocks hydraulic fluid exiting longitudinal fluid bypass channel 66 via second end 56. Hydraulic fluid, therefore, flows along longitudinal fluid bypass channel 66 exiting through second radial fluid bypass port 69 until second radial fluid bypass port 69 is blocked by the entry into interior bore 59 of annular valve member 10 of enlarged diameter portion 36 of mandrel 14. Referring to FIG. 4, as enlarged diameter portion 36 of mandrel 14 advances into interior bore 59 of annular valve member 10, the flow of hydraulic fluid through second radial fluid bypass port 69 is restricted thereby slowing mandrel 14 for positioning within interior bore 59 of annular valve member 10 in preparation for another jarring cycle.

Figure 7:
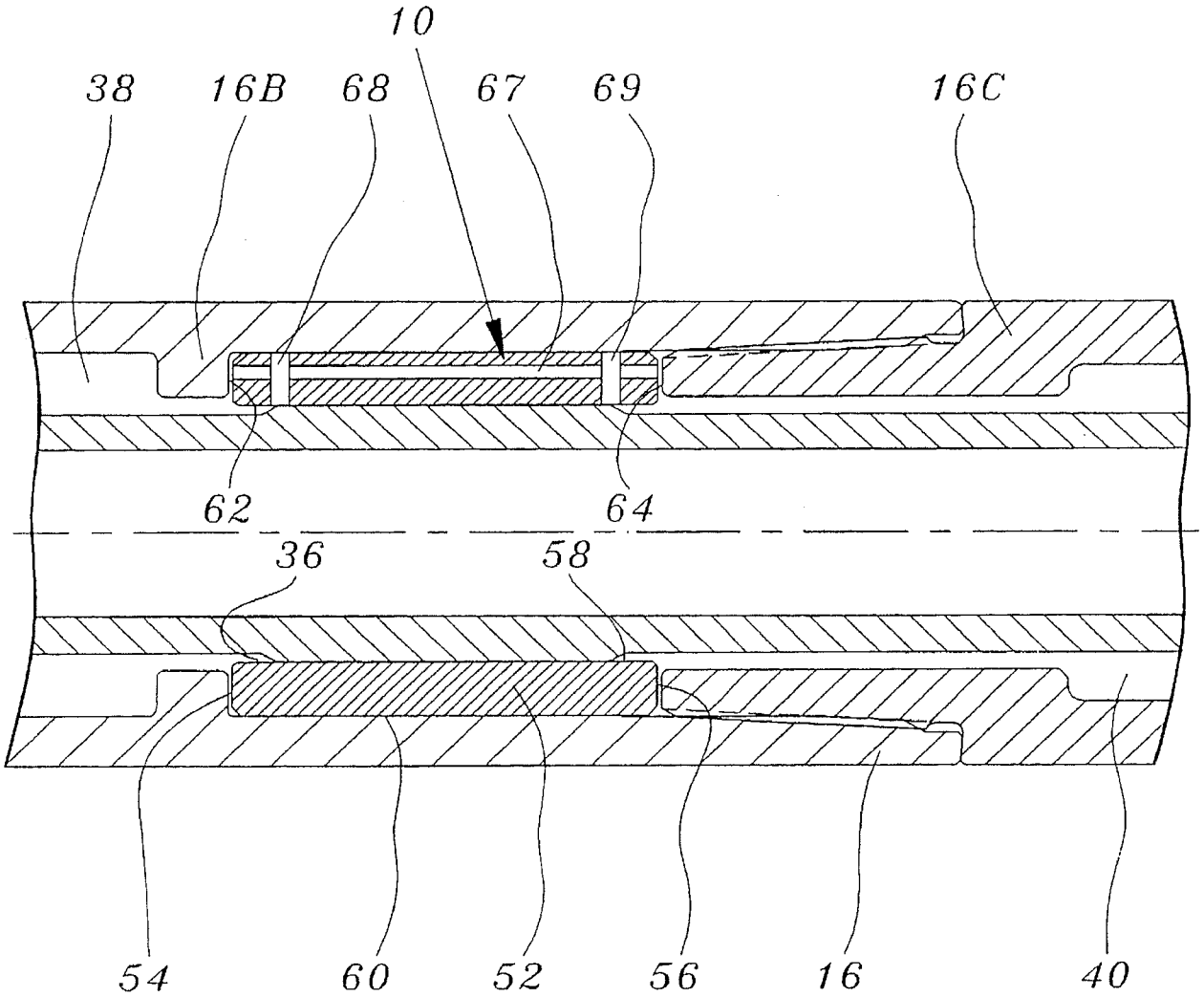
FIG. 7 is a longitudinal section view of an hydraulic drilling jar with an alternative form of annular valve member.

Referring to FIG. 7, there is provided an annular valve member that is functionally the same as the annular valve member illustrated in FIGS. 3 and 4, with the exception that a different configuration of longitudinal fluid bypass channel is provided. A longitudinal fluid bypass channel 67 is provided that extends through sidewall 52 of annular valve member 10. The operation is the same as described with respect to FIGS. 3 and 4.

Figure 5:
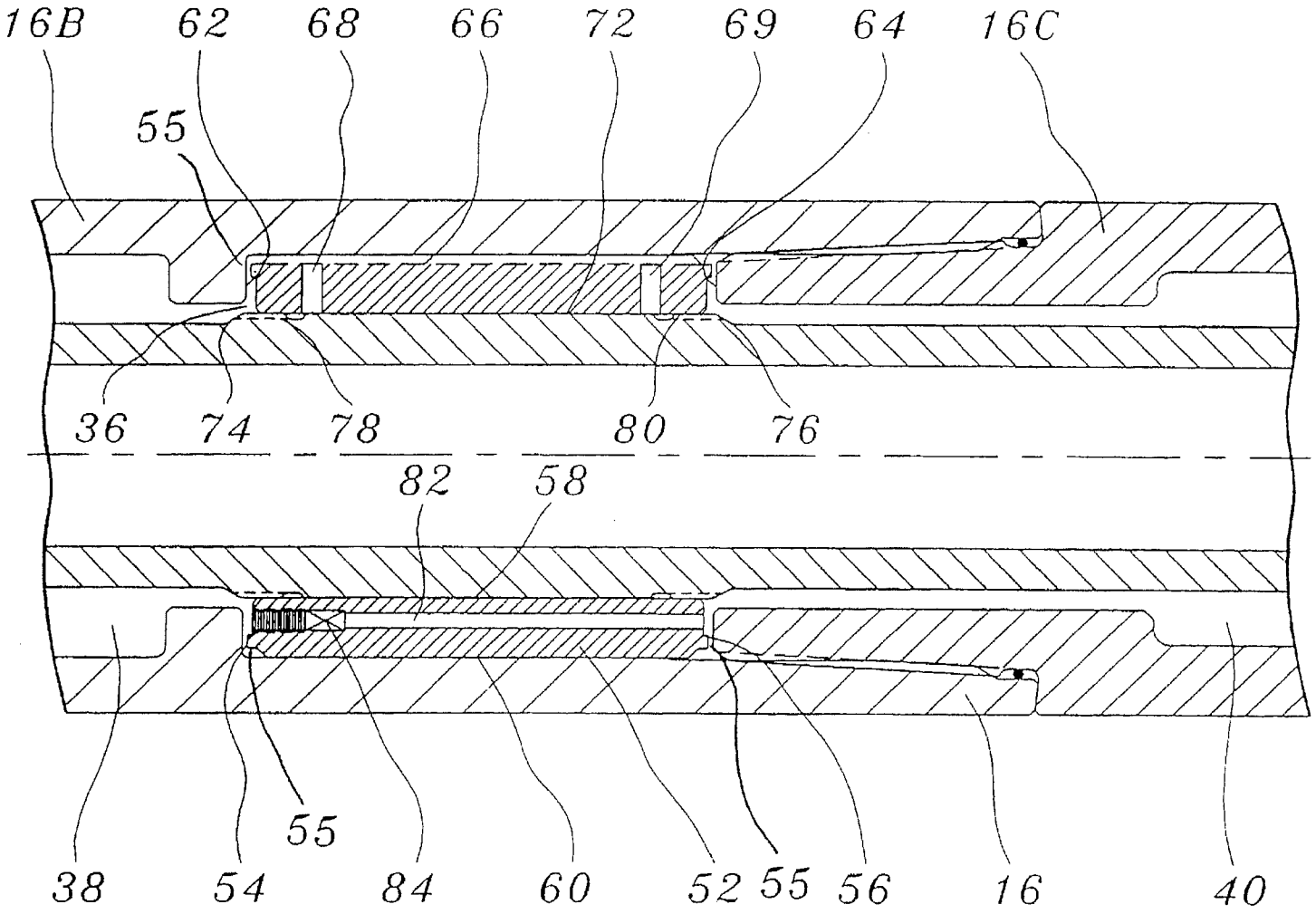
FIG. 5 is a longitudinal section view of an hydraulic drilling jar with an alternative form of annular valve member.

Referring to FIG. 5, there is illustrated a further alternative version. In order to improve operation enlarged diameter portion 36 of mandrel 14 has been modified. Enlarged diameter portion 36 has an exterior surface 72, a first end 74 and a second end 76. A first fluid bypass channel 78 is positioned in exterior surface 72 adjacent first end 74. A second fluid bypass channel 80 is positioned in exterior surface 72 adjacent second end 76. First fluid bypass channel 78 and second fluid bypass channel 80 help define a central stopping position for mandrel 14 within interior bore 59 of annular valve member 10. First fluid bypass channel 78 is in fluid communication with first radial bypass port 68 of annular valve member 10. Second fluid bypass channel 80 is in fluid communication with second radial bypass port 69 of annular valve member 10. When enlarged diameter portion 36 of mandrel 14 is entering interior bore 59 of annular valve member 10 from portion 38 of fluid chamber 30, hydraulic fluid can communicate via first fluid bypass channel 78 with first radial bypass port 68 as enlarged diameter portion 36 of mandrel 14 is pushed into annular valve member 10. Similarly, when enlarged diameter portion 36 of mandrel 14 is entering interior bore 59 of annular valve member 10 from portion 40 of fluid chamber 30, hydraulic fluid can communicate via second fluid bypass channel 80 with second radial bypass port 69 as enlarged diameter portion 36 is pushed into annular valve member 10. A sealing face 55 extends from each of first end 54 and second end 56 of annular valve member 10. A plurality of longitudinal fluid bypass channels 66 and a plurality of longitudinal fluid bypass channels 82 are provided, all of which extend longitudinally between first end 54 and second end 56 of valve member. Longitudinal fluid bypass channels 82 are positioned intermediate sealing face 55 and interior surface 58 of valve member 10. When a force is exerted upon mandrel 14 to push enlarged diameter portion 36 of mandrel 14 into interior bore 59 of annular valve member 10, annular valve member is pushed against one of projecting shoulders 62 or 64. This blocks the flow of fluids through longitudinal fluid bypass channels 66. The positioning of sealing face 55 is such that shoulders 62 and 64 do not block longitudinal fluid bypass channels 82. It will, therefore, be understood that fluid is always able to flow through longitudinal bypass channels 82. A metering device 84 is disposed in longitudinal fluid bypass passages 82 to meter the flow of hydraulic fluid. The time delay between the exertion of a force upon drilling jar 12 and the jarring impact resulting from enlarged diameter portion 36 of mandrel 14 moving out of interior bore 59 of annular valve member 10, is a function of the pressure and volume of hydraulic fluid flowing through longitudinal fluid bypass passage 82. The purpose of utilizing metering device 84 is to control the time delay and make such time delay predictable.

Figure 6:
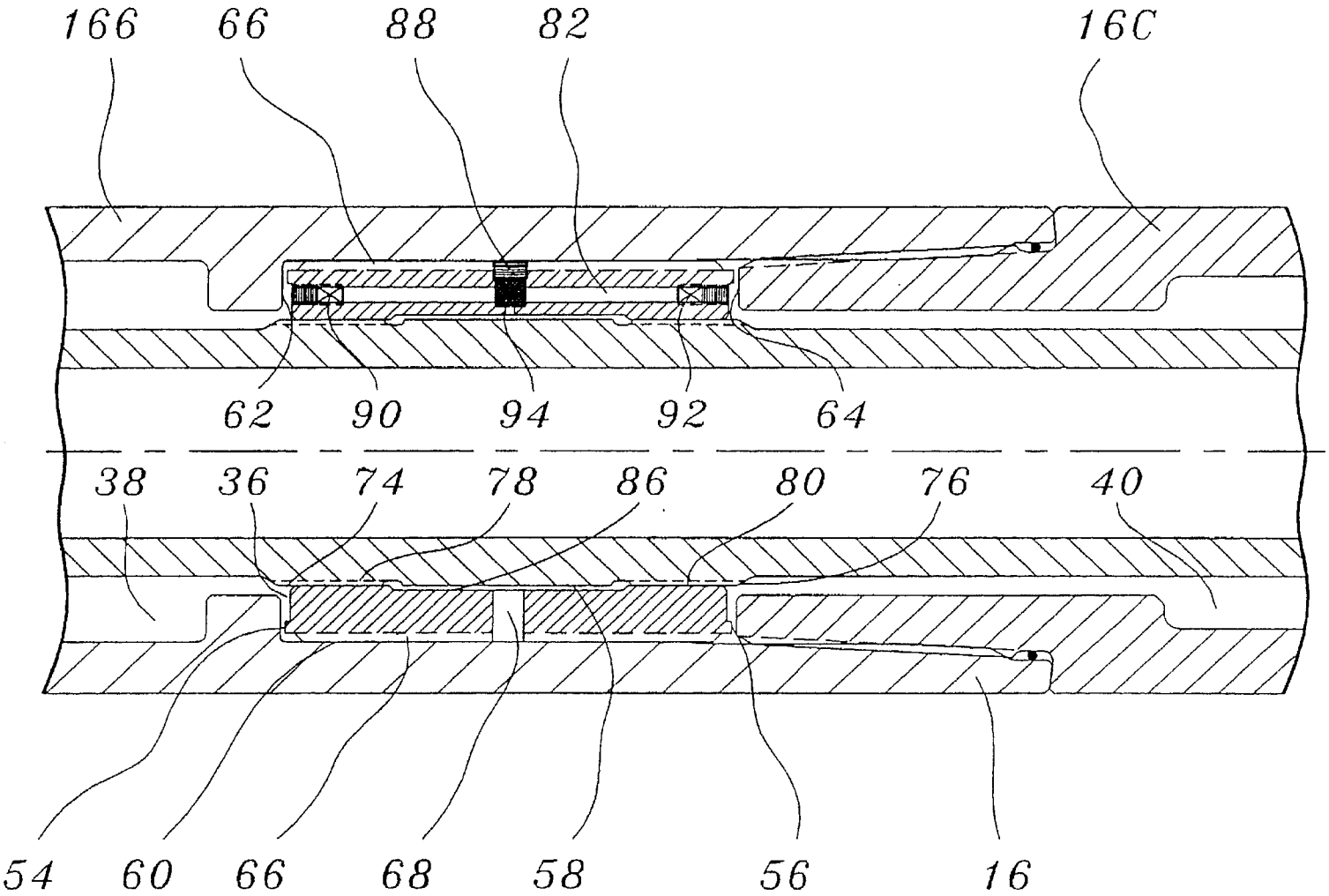
FIG. 6 is a longitudinal section view of the annular valve member from the hydraulic drilling jar illustrated in FIG. 1.

FIG. 6 is illustrated in order to illustrated how these various teachings can be combined with a single radial bypass port. A single radial bypass port 68 is provided for each longitudinal fluid bypass channel 66. Single radial bypass port 68 is substantially centrally positioned intermediate first end 54 and second end 56 of annular valve member 10. As with the embodiment illustrated in FIG. 5, enlarged diameter portion 36 of mandrel 14 has first fluid bypass channel 78 and second fluid bypass channel 80 to help define a central position stopping position for mandrel 14 within interior bore 59 of annular valve member 10. Annular valve member 10 has a slightly stepped down surface 86 on interior surface 58 in the vicinity of radial fluid bypass port 68. Stepped down surface 86 assists in central positioning using a single radial fluid bypass port 68. Each longitudinal fluid bypass passage 82 is also provided with a radial fluid bypass port 88. Metering devices 90 and 92 are placed at either end of longitudinal fluid bypass passage 82 to meter the flow and control the resulting time delay prior to jarring impact. A filter 94 is disposed in longitudinal bypass passage 82 for the purpose of filtering contaminants from the flow of hydraulic fluid.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A two way hydraulic drilling jar, comprising:

a tubular housing having a first end, a second end and an interior surface defining an interior bore;

a mandrel having a first end, a second end and an exterior surface, the mandrel being telescopically received within the interior bore of the tubular housing, the exterior surface of the mandrel having an enlarged diameter portion;

first sealing means disposed between the interior surface of the housing and the exterior surface of the mandrel at the first end of the housing;

second sealing means disposed between the interior surface of the housing and the exterior surface of the mandrel at the second end of the housing;

an annular fluid chamber formed between the exterior surface of the mandrel and the interior surface of the housing having a first end defined by the first sealing means and a second end defined by the second sealing means;

an annular valve member having an annular sidewall, a first end, a second end, an exterior surface, and an interior surface defining an interior bore, the annular valve member being disposed within the fluid chamber with the mandrel extending through the interior bore, the valve member being confined with capability of limited axial movement between two shoulders projecting from the interior surface of the housing, the interior bore of the annular valve member receiving the enlarged diameter portion of the mandrel in close fitting relation;

at least one hammer on one of the mandrel and the housing;

a first anvil on the other of the mandrel and the housing that engages the at least one hammer in a jarring impact upon relative telescopic movement of the mandrel and the housing in a first direction as the enlarged portion of the mandrel exits the interior bore of the valve member;

a second anvil on the other of the mandrel and the housing that engages the at least one hammer in a jarring impact upon relative telescopic movement of the mandrel and the housing in a second direction as the enlarged portion of the mandrel exits the interior bore of the valve member; and at least one fluid bypass channel disposed in one of the valve member and the enlarged diameter portion of the exterior surface of the mandrel, the fluid bypass channel extending longitudinally between the first end and the second end of the annular valve member such that when the enlarged diameter portion of the mandrel is positioned in close fitting relation within the interior bore of the valve member, fluid can slowly bleed past to create a time delay before the enlarged diameter portion mandrel exits the interior bore of the valve member resulting in the hammer and the anvil engaging in a violent jarring impact.

2. The two way hydraulic drilling jar, as defined in claim 1, wherein a first radial fluid bypass port extends through the annular sidewall of the annular valve member adjacent the first end, a second radial fluid bypass port extends through the annular sidewall of the annular valve member adjacent the second end, such that fluids can communicate between the interior surface and the exterior surface of the annular valve member, the radial fluid bypass ports being in fluid communication with the at least one fluid bypass channel, such that when a force is exerted upon the mandrel to push the enlarged diameter portion on the exterior surface of the mandrel into the close fitting interior bore of the annular valve member and the annular valve member is pushed against one of the projecting shoulders on the interior surface of the housing thereby blocking the at least one fluid bypass channel, hydraulic fluid flowing along the at least one fluid bypass channel is able to exit through one of the radial fluid bypass ports notwithstanding blockage of the at least one fluid bypass channel by one of the shoulders, until the radial fluid bypass ports are also blocked by the enlarged diameter portion on the exterior surface of the mandrel, at which time the flow of hydraulic fluid through the radial fluid bypass ports is restricted thereby slowing the mandrel for positioning within the interior bore of the valve member in preparation for jarring.

3. The two way hydraulic drilling jar as defined in claim 2, wherein the at least one fluid bypass channel extends longitudinally along one of the interior surface and the exterior surface of the annular valve member between the first end and the second end.

4. The two way hydraulic drilling jar as defined in claim 2, wherein the at least one fluid bypass channel extends longitudinally through the annular sidewall of the annular valve member between the first end and the second end.

5. The two way hydraulic drilling jar as defined in claim 1, wherein at least one fluid bypass channel is positioned in the annular valve member extending longitudinally between the first end and the second end of the annular valve member, a radial bypass port extends through the annular sidewall of the annular valve member centrally positioned between the first end and the second end of the annular valve member such that fluids can communicate between the interior surface and the exterior surface of the annular valve member, the single radial bypass port being in fluid communication with at least one fluid bypass channel, and fluid bypass channels extending partially along the enlarged diameter portion of the exterior surface of the mandrel from opposed ends, thereby allowing fluids to communicate with the single radial bypass channel until the single radial bypass channel is substantially centrally positioned.

6. The two way hydraulic drilling jar as defined in claim 1, wherein a sealing face extends from each of the first end and the second end of the annular valve member, a plurality of fluid bypass channels are provided which extend longitudinally between the first end and the second end of the valve member, at least one of said plurality of fluid bypass channels is positioned intermediate the sealing face and the interior surface of the valve member, such that when a force is exerted upon the mandrel to push the enlarged diameter portion on the exterior surface of the mandrel into the close fitting interior bore of the annular valve member and the annular valve member is pushed against one of the projecting shoulders on the interior surface of the housing, the sealing face prevent the shoulders on the interior surface of the housing from blocking the at least one of said plurality of fluid bypass channels that is positioned intermediate the sealing face and the interior surface of the valve member.

7. The two way hydraulic drill jar as defined in claim 6, wherein at least one radial bypass port extends between some of the plurality of fluid bypass channels and the at least one of said plurality of fluid bypass channels that is positioned intermediate the sealing face and the interior surface of the valve member such that when a force is exerted upon the mandrel to push the enlarged diameter portion on the exterior surface of the mandrel into the close fitting interior bore of the annular valve member and the annular valve member is pushed against one of the projecting shoulders on the interior surface of the housing thereby blocking some of the plurality of fluid bypass channels, hydraulic fluid flowing along the some of the plurality of fluid bypass channels that are blocked is able to pass through the at least one radial fluid bypass port to the at least one of said plurality of fluid bypass channels that is positioned intermediate the sealing face and the interior surface of the valve member which is not blocked.

8. The two way hydraulic drilling jar as defined in claim 1, wherein means for metering the flow of hydraulic fluid is provided in the at least one fluid bypass passage.

9. The two way hydraulic drilling jar as defined in claim 1, wherein means for filtering contaminants from the flow of hydraulic fluid is provided in the at least one fluid bypass passage.

* * * * *